US008113603B2

(12) United States Patent
Park et al.

(10) Patent No.: US 8,113,603 B2
(45) **Date of Patent: *Feb. 14, 2012**

(54) LAUNDRY MACHINE

(75) Inventors: Jong A Park, Changwon-si (KR); Youn Su Jung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 381 days.

This patent is subject to a terminal disclaimer.

(21) Appl. No.: 12/379,697

(22) Filed: Feb. 26, 2009

(65) Prior Publication Data

US 2009/0212673 A1 Aug. 27, 2009

(30) Foreign Application Priority Data

Feb. 27, 2008 (KR) ..... 10-2008-0017859

(51) Int. Cl.
*A47B 77/02* (2006.01)

(52) U.S. Cl. ..... 312/228; 312/351.2; 248/678

(58) Field of Classification Search ..... 312/228, 312/351.1, 351.2, 257.1, 107, 352; 248/551, 248/678, 680, 188, 188.1, 188.5; 68/3 R, 68/13 R See application file for complete search history.

(56) References Cited

U.S. PATENT DOCUMENTS

| | | | | |
|---|---|---|---|---|
| 6,427,966 | B1 * | 8/2002 | Blumenschein | 248/678 |
| 7,921,679 | B2 * | 4/2011 | Jo | 68/3 R |
| 2004/0263032 | A1 * | 12/2004 | Cho | 312/330.1 |
| 2005/0172678 | A1 * | 8/2005 | Kim et al. | 68/3 R |
| 2005/0275325 | A1 * | 12/2005 | Yang | 312/330.1 |
| 2006/0103281 | A1 * | 5/2006 | Cho | 312/351.2 |

FOREIGN PATENT DOCUMENTS

| | | |
|---|---|---|
| KR | 10-2004-0053623 | * 6/2004 |
| KR | 10-2004-0085516 | * 10/2004 |

* cited by examiner

*Primary Examiner* — James O Hansen

(74) *Attorney, Agent, or Firm* — McKenna Long & Aldridge LLP

(57) ABSTRACT

A laundry machine is disclosed. The laundry machine includes a cabinet defining a first receiving space to receive laundry to be treated, a plurality of legs each of which comprises a leg head located at an installation surface and a leg body configured to connect the leg head to the cabinet, a sub cabinet defining a second receiving space having a volume less than the first receiving space, the sub cabinet being coupled to a bottom of the cabinet, and a plurality of coupling members configured to detachably couple the sub cabinet to the cabinet. According to this laundry machine, it is possible to easily achieve the coupling and separation between the cabinet and the sub cabinet.

10 Claims, 5 Drawing Sheets

LAUNDRY MACHINE

CROSS-REFERENCE TO RELATED APPLICATION

This application claims the benefit of Korean Patent Application No. 10-2008-0017859, filed on Feb. 27, 2008, which is hereby incorporated by reference in its entirety as if fully set forth herein.

BACKGROUND OF THE INVENTION

1. Field of the Invention

The present invention relates to a laundry machine, and more particularly, to a laundry machine constructed in a structure in which a cabinet and a subcabinet are easily coupled to and separated from each other.

2. Discussion of the Related Art

Generally, based on a laundry loading method, a laundry machine may be classified as a top loading type laundry machine or a front loading type laundry machine. In recent years, there has been developed a laundry machine equipped with a sub cabinet that is capable of keeping laundry to be treated in addition to a cabinet.

FIG. 1 is a perspective view illustrating a laundry machine 1 including a sub cabinet 20. In the laundry machine 1, the sub cabinet 20 is normally located below a cabinet 10. The cabinet 10 and the sub cabinet 20 may be coupled to each other by connection devices.

SUMMARY OF THE INVENTION

Accordingly, the present invention is directed to a laundry machine that substantially obviates one or more problems due to limitations and disadvantages of the related art.

An object of the present invention is to provide a laundry machine which does not need additional connection devices when a cabinet and a sub cabinet are connected to each other.

Another object of the present invention is to provide a laundry machine constructed in a structure in which a cabinet and a subcabinet are easily coupled to and separated from each other.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet defining a first receiving space to receive laundry to be treated, a plurality of legs each of which comprises a leg head located at an installation surface and a leg body configured to connect the leg head to the cabinet, a sub cabinet defining a second receiving space having a volume less than the first receiving space, the sub cabinet being coupled to a bottom of the cabinet, and a plurality of coupling members configured to detachably couple the sub cabinet to the cabinet.

Each of the coupling members may include a leg bracket coupled to a bottom of the cabinet and a fixing bracket coupled to a top of the sub cabinet such that the fixing bracket is detachably fastened to the leg bracket.

The leg bracket may include a bracket body coupled to the cabinet and a leg insertion hole formed through the bracket body for allowing the corresponding leg body to be inserted therethrough.

The leg bracket may further include a support part formed along a circumference of the leg insertion hole, such that the support part protrudes downward toward the fixing bracket, for supporting the corresponding leg.

The fixing bracket may include a location part in which the corresponding leg head is located.

The location part may be formed in a shape corresponding to that of the corresponding leg head.

The leg bracket may further include a fastening part extending from the bracket body such that the fastening part is detachably connected to the fixing bracket.

The fixing bracket may further include a connection part formed in a shape corresponding to that of the fastening part such that the fastening part is coupled to the connection part.

The fastening part may extend downward from one side of the bracket body toward the connection part.

The connection part may have a shape corresponding to that of the fastening part.

The leg bracket may further include a plurality of fastening holes formed such that the leg bracket is coupled to the cabinet.

The fixing bracket may include a plurality of coupling holes formed such that the fixing bracket is coupled to the sub cabinet.

The leg bracket may further include a leg insertion hole is provided at a position corresponding to the leg body of the corresponding leg disposed at a corresponding bottom corner of the cabinet.

The leg bracket may further include a location groove in which a cabinet bracket coupled to the bottom of the cabinet for supporting the leg body is located.

The location part may be formed at a position corresponding to that of the leg head in a state in which the leg bracket is coupled to the cabinet.

In another aspect of the present invention, a laundry machine includes a cabinet defining a first receiving space to receive laundry to be treated, a plurality of legs each of which comprises a leg head located at an installation surface and a leg body configured to connect the leg head to the cabinet, a sub cabinet defining a second receiving space having a volume less than the first receiving space, the sub cabinet being coupled to a bottom of the cabinet, and a plurality of coupling members configured to interconnect the cabinet and the sub cabinet to support the legs, each of the coupling members including a leg bracket coupled to the cabinet and a fixing bracket coupled to the sub cabinet such that the fixing bracket is detachably fastened to the leg bracket.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
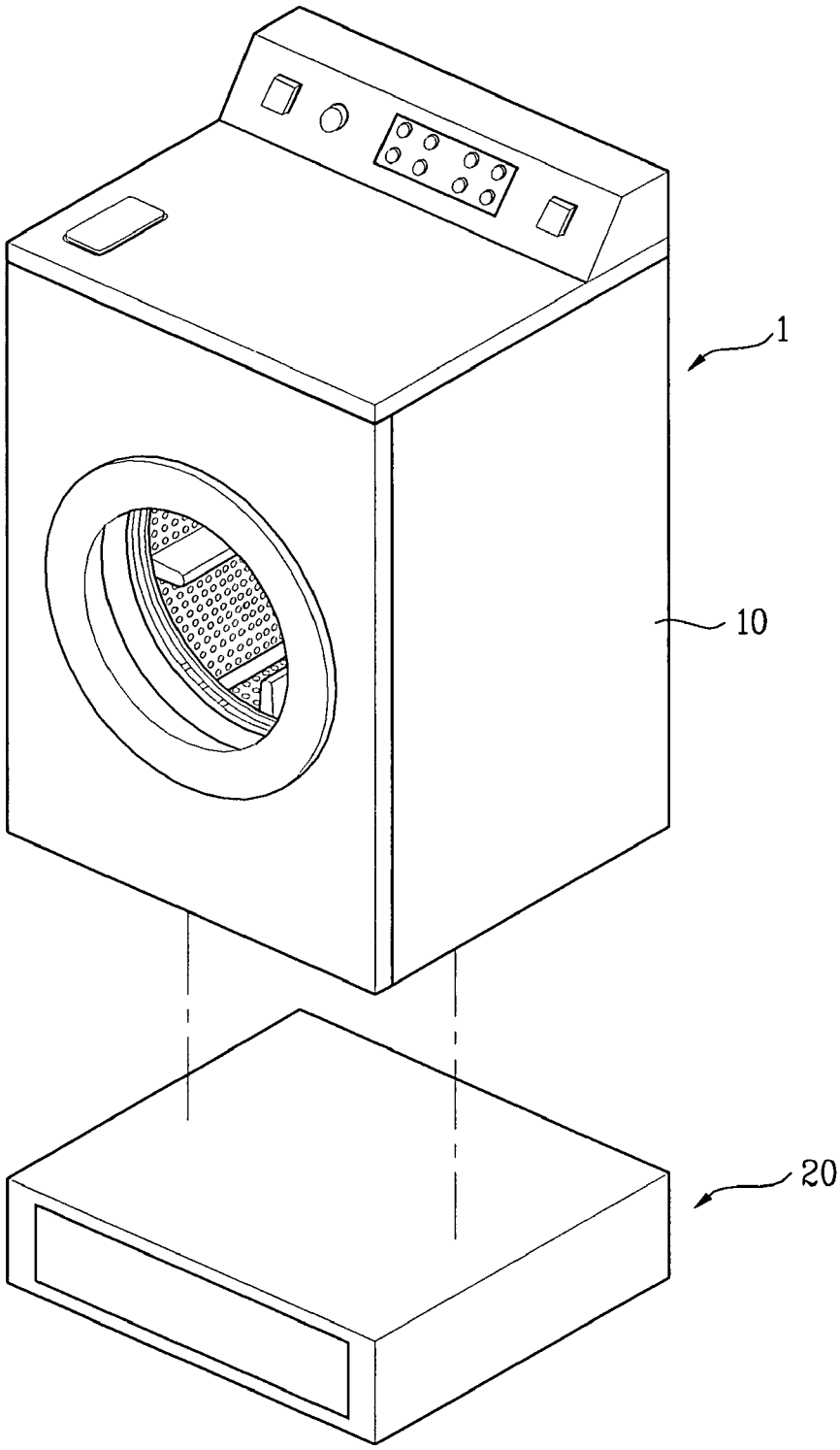
Fig. 1 Related Art
FIG. 1 is an exploded perspective view illustrating a conventional laundry machine including a cabinet and a sub cabinet.
Figure 2:
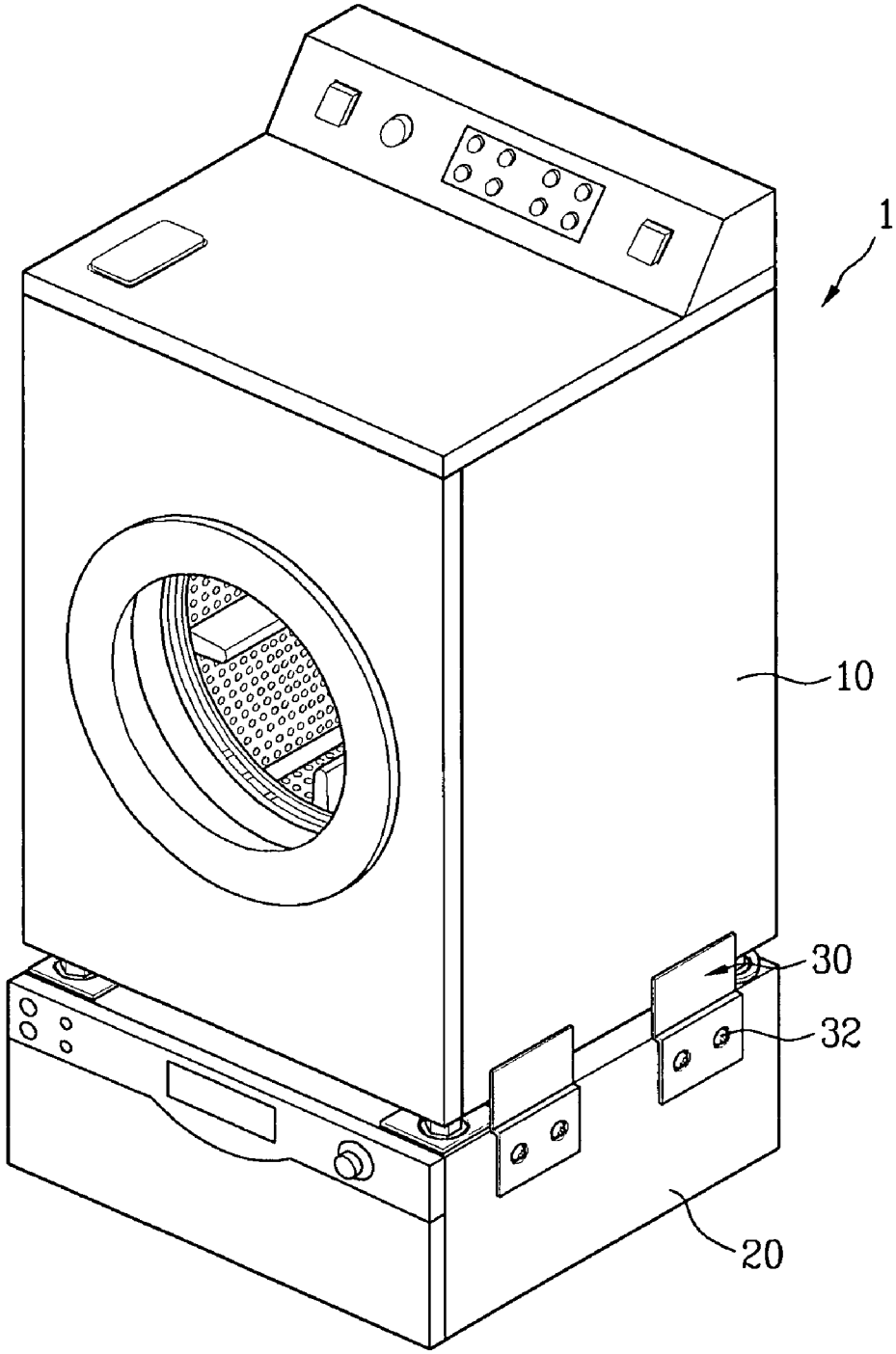
FIG. 2 is a perspective view illustrating a laundry machine including a cabinet and a sub cabinet according to an embodiment of the present invention, the cabinet and the sub cabinet being coupled to each other.

FIG. 2 is a perspective view illustrating a laundry machine including a cabinet 10 and a sub cabinet 20 according to an embodiment of the present invention, the cabinet and the sub cabinet being coupled to each other by connection devices. In this embodiment, as shown in FIG. 2, the cabinet 10 and the sub cabinet 20 are coupled to each other by coupling members 30. Specifically, each coupling member 30 is provided at corresponding sides of the cabinet 10 and the sub cabinet 20. Each coupling member 30 is connected to the cabinet 20 by an adhesive and to the sub cabinet 20 by screws 32.

Another type of coupling members, which will be described hereinafter, may be applied to achieve easier coupling and separation between the coupling members 30.

Figure 3:
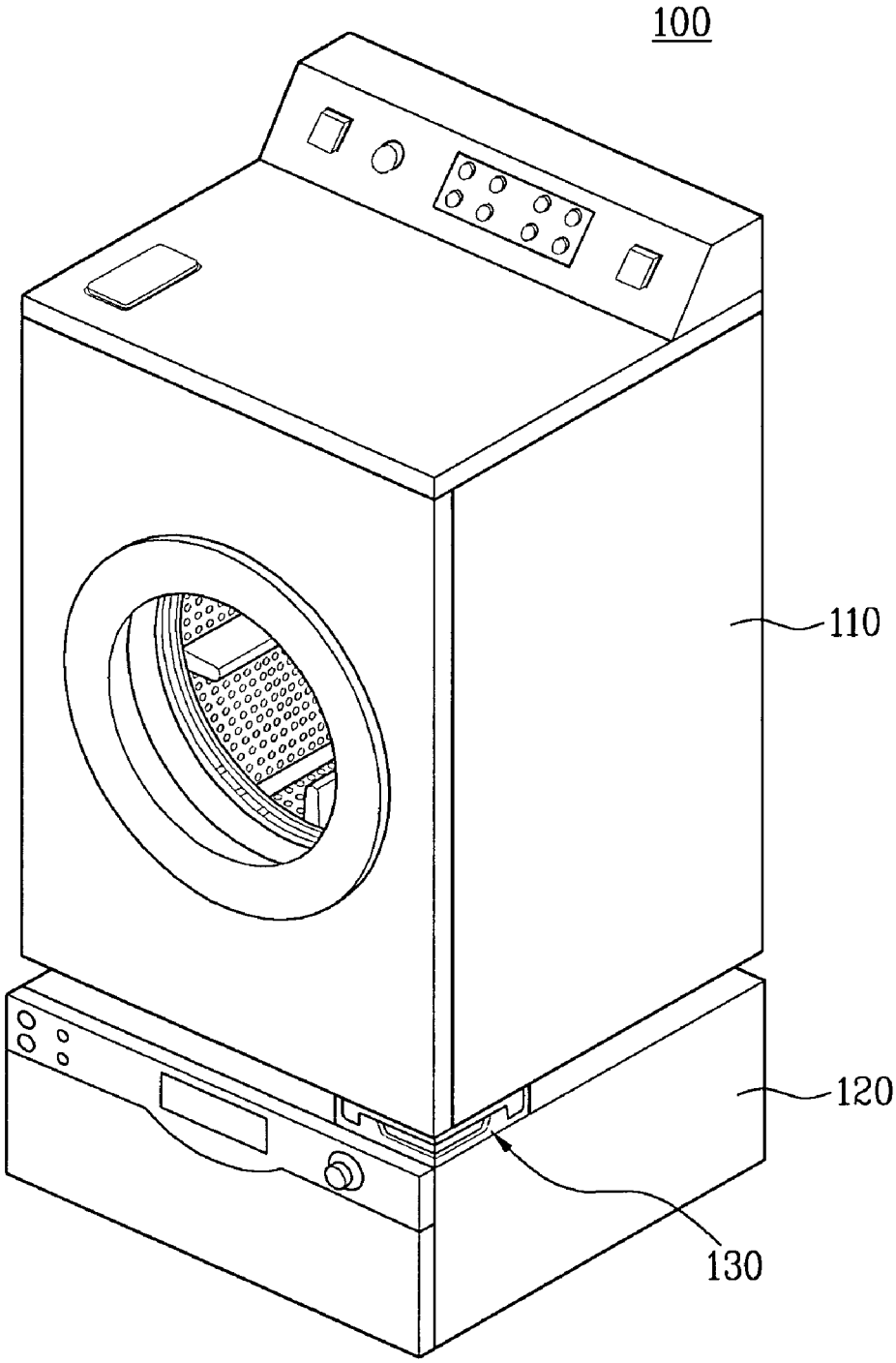
FIG. 3 is a perspective view illustrating a laundry machine including a cabinet and a sub cabinet according to another embodiment of the present invention, the cabinet and the sub cabinet being coupled to each other.

FIG. 3 is a perspective view illustrating a laundry machine 100 according to another embodiment of the present invention, a cabinet 110 and a sub cabinet 120 being coupled to each other.

Referring to FIG. 3, the laundry machine 100 includes a cabinet 110 configured to receive laundry to be treated, a sub cabinet 120 coupled to the bottom of the cabinet 110, and coupling members 130 configured to be detachably connected between the cabinet 110 and the sub cabinet 120 to couple the cabinet 110 and the sub cabinet 120 to each other.

The coupling members 130 couple the cabinet 110 and the sub cabinet 120 to each other. The coupling members 130 are detachably connected between the cabinet 110 and the sub cabinet 120. Since the coupling members 130 are detachably connected between the cabinet 110 and the sub cabinet 120, it is possible to repeatedly achieve the coupling and separation between the cabinet 110 and the sub cabinet 120.

Figure 4:
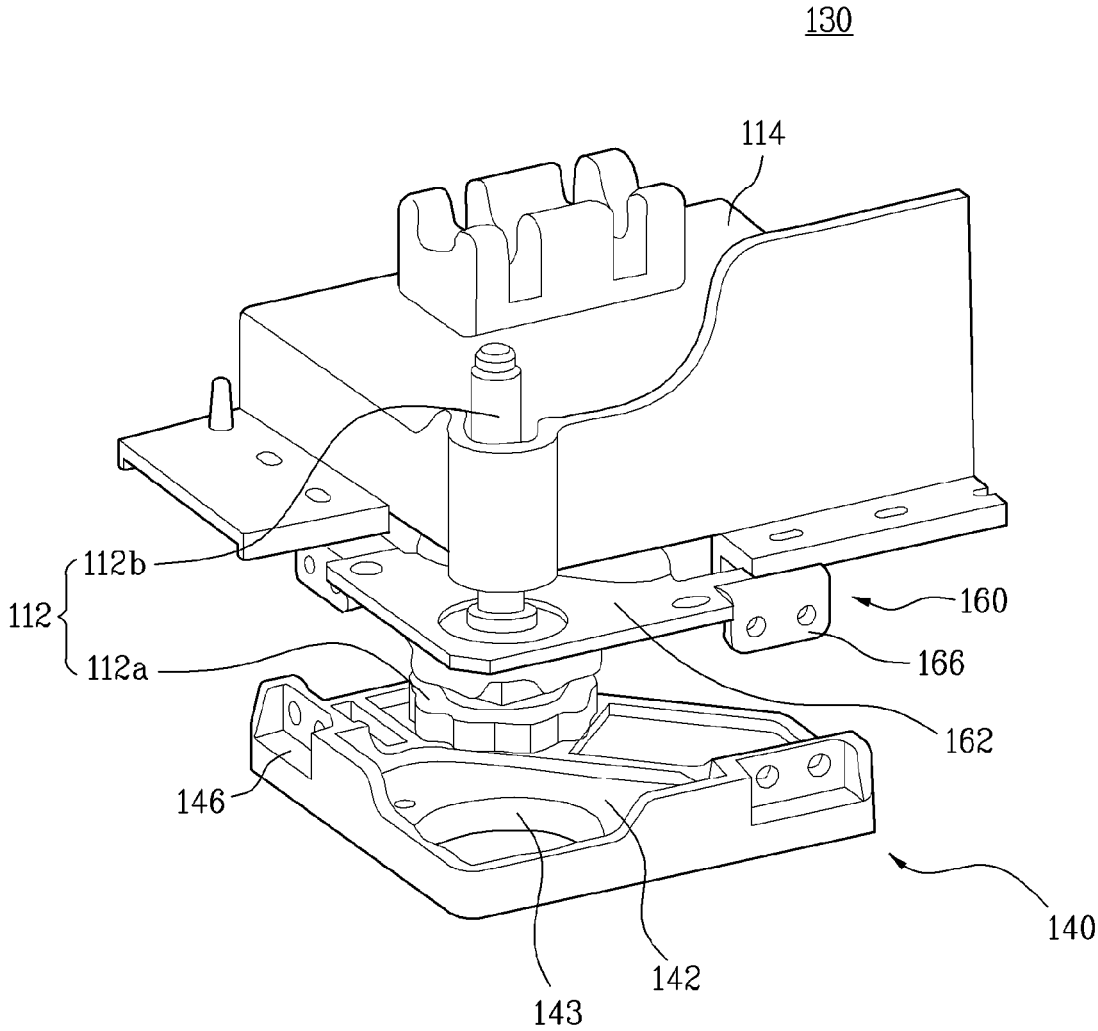
FIG. 4 is a perspective view illustrating a coupling member of FIG. 3.

FIG. 4 is a perspective view illustrating a coupling member 130 disassembled from the laundry machine shown in FIG. 3.

Referring to FIG. 4, the coupling member 130 includes a fixing bracket 140 disposed at the top of the sub cabinet 120 (see FIG. 3) and a leg bracket 160 disposed at the bottom of the cabinet 110 (see FIG. 3).

A leg 112 of the cabinet 110 includes a leg head 112*a* located at an installation surface and a leg body 112*b* connected to the leg head 112*a*.

Since the leg 112 is generally located adjacent to a corresponding corner at the lower part of the cabinet 110, it is preferable for the leg bracket 160 to be located adjacent to a corresponding corner at the bottom of the cabinet 110.

The leg bracket 160 is connected to the fixing bracket 140 disposed at the top of the sub cabinet 120, with the result that the cabinet 110 and the sub cabinet 120 are detachably connected to each other. When the separation between the cabinet 110 and the sub cabinet 12 is required, therefore, it is possible to easily separate the cabinet 110 and the sub cabinet 12 from each other only by the separation between the leg bracket 160 and the fixing bracket 140.

Figure 5:
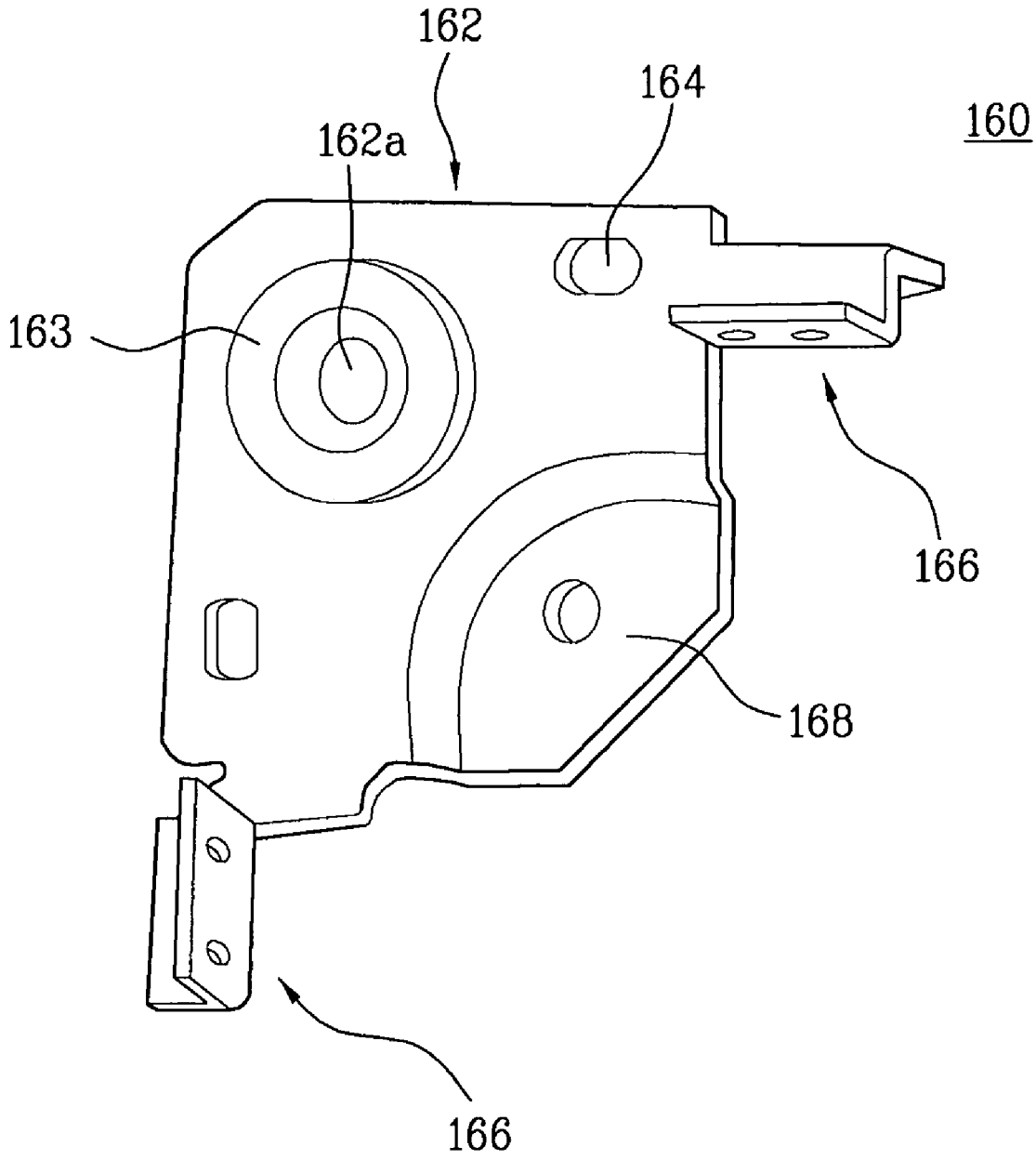
FIG. 5 is a perspective view illustrating a leg bracket of FIG. 4.

FIG. 5 is a perspective view illustrating only the leg bracket 160 of FIG. 4 when viewed from the bottom of the leg bracket 160.

Referring to FIGS. 4 and 5, the leg bracket 160 is disposed at the bottom of the cabinet 110 to support the leg 112 of the cabinet 110. The leg bracket 160 is detachably connected to the fixing bracket 140 disposed at the top of the sub cabinet 120.

The leg bracket 160 includes a bracket body 162 configured to be fastened to a cabinet bracket 114 coupled to the bottom of the cabinet 110, a leg insertion hole 162*a* through which the leg body 112 is inserted, a support part 163 protruding along the circumference of the leg insertion hole 162*a*, a plurality of fastening holes 164 through which screws are inserted to fasten the leg bracket 160 to the cabinet 110, and a location groove 168 in which the cabinet bracket 114 is located. Also, the leg bracket 160 further includes a fastening part 166 configured to detachably connect the leg bracket 160 to the fixing bracket 140.

The bracket body 162 forms a body of the leg bracket 160. The bracket body 162 is disposed at the bottom of the cabinet 110 to support the leg 112 of the cabinet 110. (Exactly, the leg is supported by the support part formed at the bracket body.)

The bracket body 162 is located adjacent to a corresponding corner at the bottom of the cabinet 110. Therefore, it is preferable for the bracket body 162 to be formed approximately in the shape of L. The leg insertion hole 162*a*, through which the leg body 112*b* is inserted, is formed through the bracket body 162 at one side thereof. It is preferable for the leg insertion hole 162*a* to be formed at a position corresponding to that of the leg body 112*b* in a shape corresponding to that of the leg body 112*b*.

One or more fastening holes 164 are formed at the bracket body 162. Screws are coupled the lower part of the cabinet 110 through the fastening holes 164 to connect the leg bracket 160 to the cabinet 110.

The fastening part 166, configured to be connected to the fixing bracket 140, is formed at one side of the bracket body 162. The fastening part extends vertically downward from one side of the bracket body 162 toward the fixing bracket 140. That is, the fastening part 166 is bent downward from one side of the bracket body 162.

It is preferable for the fastening part 166 to be formed integrally with the bracket body 162, although the fastening part 166 may be formed of an additional member. One or more fastening parts 166 may be formed. When the bracket body 162 is coupled to the cabinet 110, as shown in FIG. 4, it is preferable for a pair of fastening parts 166 to be formed along regions, of the bracket body 162, exposed to the outside.

In a structure in which the fastening parts 166 are formed at the exposed regions of the bracket body 162, as described above, it is possible for a worker to easily fasten the fastening parts 166 to connection parts 146, which will be described later, of the fixing bracket 140 from the outside.

Meanwhile, referring back to FIG. 4, the fixing bracket 140 is disposed at the top of the sub cabinet 120 (see FIG. 3). The fixing bracket 140 may be formed integrally with the sub cabinet 120. Alternatively, the fixing bracket 140 may be formed of an additional member. Since the fixing bracket 140 is connected to the leg bracket 160 described above, it is preferable for the fixing bracket 140 to be located adjacent to a corresponding corner at the top of the sub cabinet 120. Also, in a case in which the fixing bracket 140 is formed of an additional member, the fixing bracket 140 may be fixed to the top of the sub cabinet 120 by screws. For this, the fixing bracket 140 further comprises a plurality of coupling holes 144 formed such that the fixing bracket 140 is coupled to the sub cabinet 120.

The fixing bracket 140 includes a location part 142 in which the leg head 112*a* is located and connection parts 146 configured to be connected to the fastening parts 166 of the leg bracket 160.

The location part 142 defines a space in which the leg head 112*a* of the cabinet 110 is located. Specifically, as shown in FIG. 4, the location part 142 is provided with a depression 143 having a shape and size corresponding to those of the leg head 112*a*.

Consequently, when the cabinet 110 and the sub cabinet 120 are coupled to each other, the leg head 112*a* of the cabinet 110 is located in the depression 143 defined in the location part 142. Also, the depression 143 is formed with a shape and size corresponding to those of the leg 112, and therefore, the movement of the leg 112 of the cabinet 110 is prevented when the cabinet 110 and the sub cabinet 120 are coupled to each other.

Meanwhile, the connection parts 146 receive the corresponding fastening parts 166 of the leg bracket 160 and are coupled to the corresponding fastening parts 166, with the result that the leg bracket 160 is coupled to the sub cabinet 120. Consequently, each connection part 146 has a shape corresponding to that of each fastening part 166. For example, each connection part 146 may be a depression having a shape corresponding to that of each fastening part 166.

Consequently, when the fastening parts 166 are connected to the corresponding connection parts 146, the fastening parts 166 are inserted into the corresponding connection parts 146 to prevent the movement of the leg bracket 160.

The connection between the fastening parts 166 and the corresponding connection parts 146 may be achieved by various methods. In this embodiment, the connection between the fastening parts 166 and the corresponding connection parts 146 is achieved by screws, to which, however, the present invention is not limited.

Since the connection parts 146 and the corresponding fastening parts 166 are detachably connected to each other, it is possible to easily achieve the coupling and separation between the cabinet 110 and the sub cabinet 120.

In the laundry machine according to this embodiment as described above, the coupling between the cabinet 110 and the sub cabinet 120 is achieved using the leg bracket 160 configured to support the leg 112 of the cabinet 110 without using an additional member. Consequently, it is possible to easily achieve the coupling between the cabinet 110 and the sub cabinet 120, and, in addition, it is possible to repeatedly achieve the coupling and separation between the cabinet 110 and the sub cabinet 120.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet defining a first receiving space to receive laundry to be treated;

a plurality of legs each of which comprises a leg head located at an installation surface and a leg body configured to connect the leg head to the cabinet;

a sub cabinet defining a second receiving space having a volume less than the first receiving space, the sub cabinet being coupled to a bottom of the cabinet; and a plurality of coupling members configured to detachably couple the sub cabinet to the cabinet, wherein each of the coupling members comprises:

a leg bracket coupled to a bottom of the cabinet; and a fixing bracket coupled to a top of the sub cabinet such that the fixing bracket is detachably fastened to the leg bracket, and wherein the leg bracket comprises:

a bracket body coupled to the cabinet; and a leg insertion hole formed through the bracket body for allowing the corresponding leg body to be inserted therethrough, wherein the leg bracket further comprises a fastening part extending from a body of the leg bracket such that the fastening part is detachably connected to the fixing bracket, and wherein the fixing bracket further comprises a connection part formed in a shape corresponding to that of the fastening part such that the fastening part is coupled to the connection part.

2. The laundry machine according to claim 1, wherein the leg bracket further comprises a support part formed along a circumference of the leg insertion hole, such that the support part protrudes downward toward the fixing bracket, for supporting the corresponding leg.

3. The laundry machine according to claim 1, wherein the fixing bracket comprises a location part in which the corresponding leg head is located.

4. The laundry machine according to claim 3, wherein the location part is formed in a shape corresponding to that of the corresponding leg head.

5. The laundry machine according to claim 3, wherein the fixing bracket further comprises a plurality of coupling holes formed such that the fixing bracket is coupled to the sub cabinet.

6. The laundry machine according to claim 3, wherein the leg bracket further comprises a location groove in which a cabinet bracket coupled to the bottom of the cabinet for supporting the leg body is located.

7. The laundry machine according to claim 3, wherein the location part is formed at a position corresponding to that of the leg head in a state in which the leg bracket is coupled to the cabinet.

8. The laundry machine according to claim 1, wherein the fastening part extends downward from one side of the bracket body toward the connection part.

9. The laundry machine according to claim 1, wherein the leg bracket further comprises a plurality of fastening holes formed such that the leg bracket is coupled to the cabinet.

10. The laundry machine according to claim 1, wherein the leg bracket comprises a leg insertion hole is provided at a position corresponding to the leg body of the corresponding leg disposed at a corresponding bottom corner of the cabinet.

* * * * *